United States Patent [19]

Friedman

[11] Patent Number: 4,470,654

[45] Date of Patent: Sep. 11, 1984

[54] ELECTRICAL CABLE CONNECTOR

[75] Inventor: Glenn Friedman, West Redding, Conn.

[73] Assignee: Burndy Corporation, Norwalk, Conn.

[21] Appl. No.: 370,003

[22] Filed: Apr. 20, 1982

[51] Int. Cl.[3] ..... H01R 4/54; H01R 11/24

[52] U.S. Cl. ..... 339/95 B; 339/228

[58] Field of Search ..... 339/228, 95 B, 226

[56] References Cited

U.S. PATENT DOCUMENTS

| | | | |
|---|---|---|---|
| 1,924,482 | 8/1933 | Berkshier et al. | 339/95 B |
| 1,953,821 | 4/1934 | Rabe | 339/228 |
| 2,125,579 | 8/1938 | O'Brien | 339/95 B |
| 2,168,250 | 8/1939 | Toilberg et al. | 339/45 R X |
| 3,662,322 | 5/1972 | Morrison | 339/228 X |
| 4,270,827 | 6/1981 | Potgioter | 339/228 X |

FOREIGN PATENT DOCUMENTS

| | | | |
|---|---|---|---|
| 972740 | 10/1964 | United Kingdom | 339/228 |
| 2058488 | 4/1981 | United Kingdom | 339/228 |

*Primary Examiner*—William R. Briggs

*Attorney, Agent, or Firm*—Howard S. Reiter

[57] ABSTRACT

An interfitting conductive collar and latch probe assembly for securely connecting a conductor, such as a wire or cable, to the post of a power source, such as a battery terminal. The assembly relies upon spring force and detent arrangements to permit installation and removal quickly, by hand, without need of a tool.

7 Claims, 6 Drawing Figures

ELECTRICAL CABLE CONNECTOR

BACKGROUND OF THE INVENTION

This invention relates most closely to removeable collar assemblies for connecting battery terminals to cables or wires, for example, in automobiles.

Several types of conductive collars are well known and used for securing electrical cables to battery terminal posts. Everyone is familiar with the common auto battery cable neck brace, which is slotted and fits over and around the terminal. It is secured and removed by tightening or loosening a screw fitted through two opposed openings in the slot area of the brace. Generally, either a wrench or screwdriver is required for installation and removal.

Another somewhat less familiar type of connector uses an insulating collar having a spring-loaded conductive probe or rod therethrough which forcibly contacts the battery post, or in some cases, is forced into an opening in the post and is held there by the spring compression tension. Here also a wrench is needed to install or remove the connector.

The problems and disadvantages of existing battery cable connectors are well-appreciated and include, in addition to the just-noted necessity of a tool or tools for installation or removal, corrosion and corrosion by-products used by less than air-tight contact between the connector and the battery post. Spark-gaps will, of course, contribute to corrosion and result in deterioration of both the electrical contact and the terminals and connector materials themselves. Gaps tend to increase as a result of heating, which causes expansion and contraction in the connection area during power transfers to and from the battery.

The corrosion problem emphasizes the need for as secure a contact as possible between a cable connector and battery terminal post. This has up to now mandated the use of tool strength in the installation of the connection. The obvious drawback is the requirement of a tool and the time spent in removing the connector.

While this drawback may not be particularly serious in the case of, for example, a single car battery, it becomes much more of a problem in multiple-battery power source situations, such as battery-bank power supplies used idn laboratories or in emergency power back-up systems.

Another growing multiple-battery application is found in the all-electric automobile, in which typically banks of ten to twenty batteries or more are used to power the car.

In these latter applications, large and constant power transfers through the conductors produce rapid foul-up of the connections, necessitating frequent cleaning of the battery posts and collars. The downtime from just the removal and re-installation of the connectors is significant in these situations. It would thus be of obvious value to provide an electrical cable connector which could be easily and quickly placed on and removed from a battery terminal, without sacrificing the tightness and security of standard battery or post collar connectors.

SUMMARY OF THE INVENTION

It is the principal object of this invention to provide such a connector, which may be removed and installed by handpower alone, without use of a tool.

It is a further object to provide such a connector which improves the security and tightness of the collar-to-post connection when the cable connector is in the installed mode.

These objects are realized by providing an electrical cable connector comprises a conductive collar for surrounding a conductive post or terminal member of, for example, an electric battery, the collar having an opening through its wall into the interior. A sleeve is secured to the outside of the collar generally in alignment with the opening. A conductive latch probe member is provided, the body of which fits within the collar and which has an arm extending out of the collar through the opening and into the sleeve. The body of the latch probe within the collar is configured to fit at least partially in contact with a battery post which is within and surrounded by the collar. The end of an extending finger of the latch probe which extends over the post is dimensioned to engage the interior of the collar wall under certain conditions, to act as a detent. A spring means or assembly is provided within the sleeve and adapted to urge or force the latch probe toward the section of the collar wall opposite the opening, thus gripping a conductive post between the probe and the collar. A freely-movable bearing member is installed in the sleeve to act as a wedge between the arm of the probe and the inner surface of the sleeve, and to contain the arm of the probe within the sleeve.

The foregoing connector assembly is so arranged that upward movement of the sleeve in the manner of a lever, causes the latch probe to pivot on a conductive post surrouned by the collar such that the end of the extending finger of the probe is moved into engagement with the inner wall of the collar. This orientation of the latch probe detains it against the force of the spring, and permits removal of the collar from the conductive post. Conversely, forcing the collar back down over a post moves the extending finger end of the probe out of engagement with the inner wall of the collar and secures the collar and latch probe against the post, under spring force.

DESCRIPTION OF THE INVENTION

Figure 1:
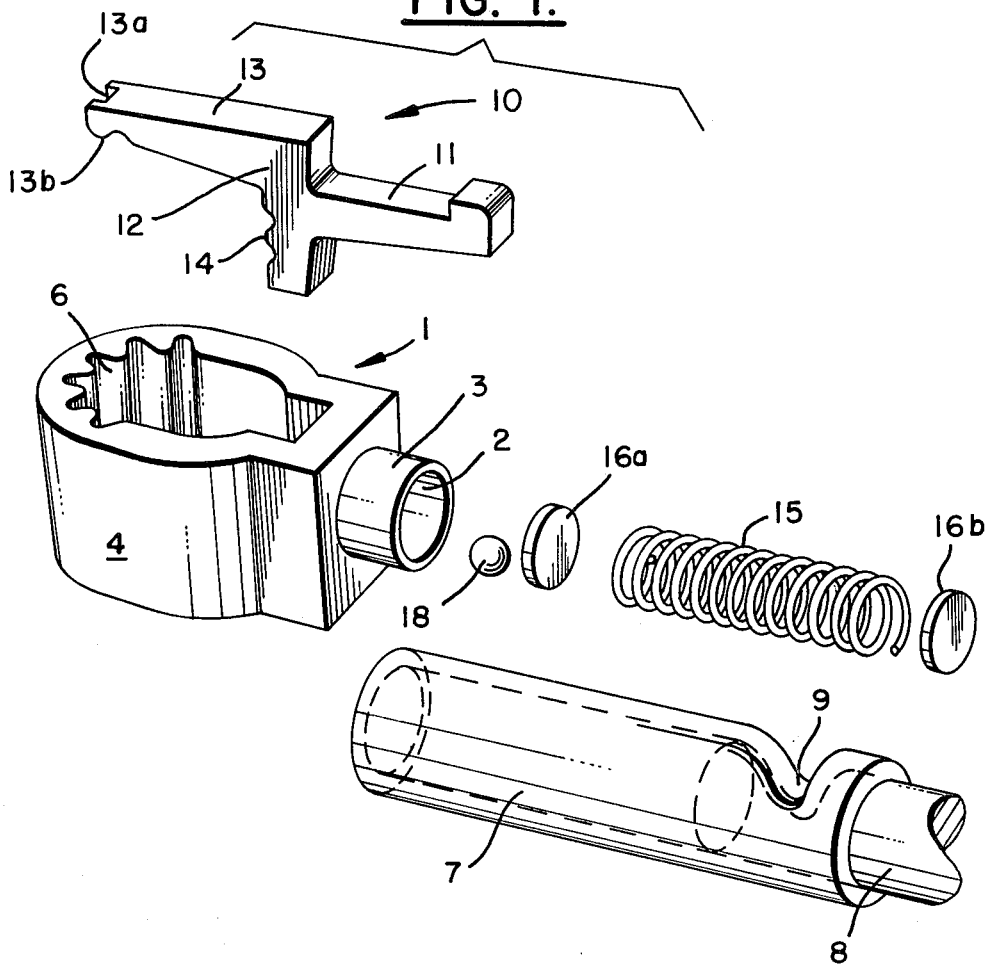
FIG. 1 is an exploded perspective view of the connector without an optional insulating cover.

Reference is made to FIG. 1 which illustrates, in exploded fashion, a preferred embodiment of the electrical cable connector of this invention. A collar 1 is shown, which is preferably comprised of a conductive material, most preferably of approximately the same electrical conductivity as the conductive post to which the connection is to be made. The easiest method of matching conductivities is to use the identical materials.

Therefore, if the terminal to be connected is comprised of copper, the collar 1 would perferably be comprised of copper as well.

While dimensions are not critical per se to this invention, obviously the internal area of the collar should be adequate to accomodate both the post to be connected and the body of the latch probe yet to be described. At one end of the collar 1 is an opening 2 which extends completely through the wall 4 of the collar. Also shown is a neck 3 extending around opening 2 for purposes of securing the sleeve, yet to be described. Neck 3 is an optional preferred feature and need not be present if another form of securing the sleeve is used.

A sleeve 7 of tubular construction is designed to fit around neck 3 adjacent to the collar wall. The sleeve is preferably constructed of conductive material, which may be similar to the collar. The other end of the sleeve will retain one end of a conductor to be connected to the terminal, generally a cable or wire 8. Any suitable method of gripping or constraining the conductor to the sleeve may be employed, such as the crimp 9 seen in the sleeve 7.

A key unique aspect of the connector of this invention is the latch probe member 10. The term "latch" has been selected to denote the locking feature of this component, and the word "probe" is used because this component perferably provides mechanical contact between the conductor 8 and the connector. The latch probe is perferably of unitary construction including an arm 11 which will extend through the opening 2 of the collar. The body 12 of the probe 10 will be substantially enclosed within the collar 1 during use, and is configured as shown to extend partially over and down a post to be connected. The extending finger portion 13 of the probe portion which fits over the top of the post is shaped to engage the section of the inner wall of the collar generally opposite opening 2. A notch at **13*a* is shaped to engage a radial projection 6 below tip 13 to assist in the movement of the top on the inner wall of the collar 1 under conditions described herein. The body 12 of the latch probe 10 perferably has a serrated or notched surface 14** on the portion of the probe which contacts the side of the post, to ensure a firm physical and electrical contact, and to provide frictional engagement with a post during removal operation.

A spring means is provided within the sleeve of the connector as assembled. A preferred embodiment of the spring means comprises a compression spring 15 with spacer elements **16*a* and 16*b*. Spacer 16*b* will be sandwiched between the spring 15 and the end of the conductor 8, and spacer 16*a* will be pressed between the spring 15 and the end of the arm 11 of the latch probe 10**.

A freely-movable bearing member 18 is provided in the sleeve 7, fitting between the elongated section of probe arm 11 and the inner surface of the sleeve. Its use will be described shortly.

Figure 2:
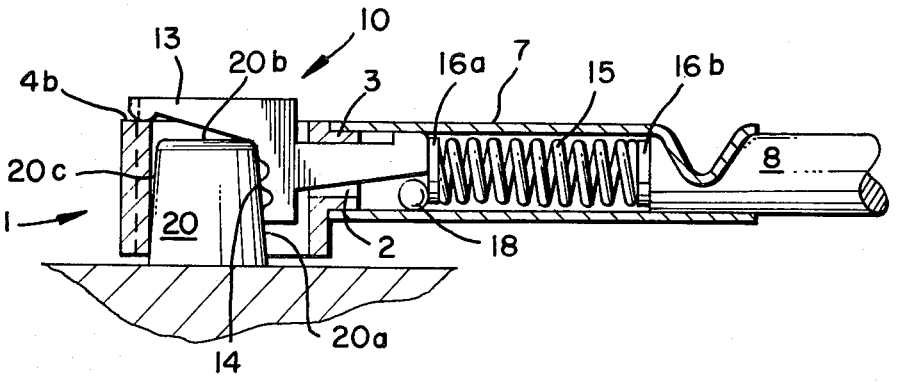
FIG. 2 is a longitudinal section view of an assembled connector in accordance with claim 1.
Figure 3:
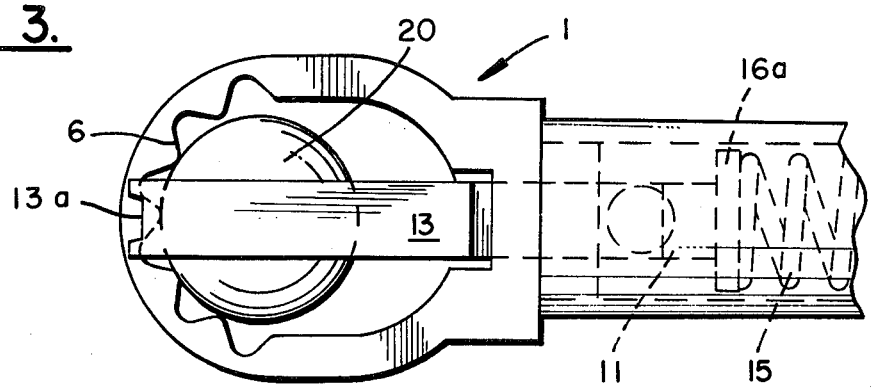
FIG. 3 is a top plan partial view of the connector of FIG. 2.

FIG. 2 shows the connector of this invention in place on a battery terminal post 20. Reference is also made to FIG. 3 which shows the connector in position on a post, in top plan view. Sleeve 7 is secured to the neck 3 of the collar 1 at the wall of the opening 2, by any suitable mechanical or other bonding means, not shown. Within the sleeve 7 is the compression spring 15, partially compressed during connector assembly, which forces spacer element **16*b* against the end of the conductor 8, and spacer element 16*a* against the end of the probe arm 11**. A preferred method of assembling the connector components will be described later.

The body 12 of the latch probe 10 can be seen to fit the post 20 partially across the top and down the side. With spring 15 forcing the latch probe 10 to the left of the illustration, the probe firmly contacts the post 20 on its side **20*a* with the serrated surface 14 of the probe, and also contacts the post at the top 20*b*** thereof.

The net effect of the force acting on the probe 10 and the post 20 is to pull the end of the collar opposite the opening 2 toward the post, and this provides a relatively air-tight fit between the collar 1 and the other side of the post **20*c***.

The latch probe 10 is so shaped and configured with respect to the geometry of the post 20, that, with the connector in the position of FIG. 3, i.e., in contact with the post of the battery, the tip surface **13*b* of the probe 10 is forcibly resident on the upper surface 4*b* of the collar 1. It will be noted that tip portion 13*a* projects beyond the inner surface of wall 4, and specifically beyond inner projection 6** on the wall.

Freely moveable bearing member 18, in this case a ball bearing, serves as a wedge or a stop for the arm 11 of the probe. As perhaps best seen from FIG. **4*a*, it is placed between the underside of the elongated portion of the arm 11 and the inner surface of the sleeve 7. When the connector is "at rest" without a battery post terminal in postion, bearing 18 will be wedged against the arm 11, the inner surface of the sleeve 7, and spacer element 16*a*. This effectively prevents the probe arm from sliding out of the collar through the opening 2, by forcing arm 11 up so that shoulder 11*a* is maintained in contact with the end of neck 3. It is noted that in the absence of bearing 18, arm 11*a* may pass freely through opening 2** for assembly and disassembly purposes.

Figure 4A:
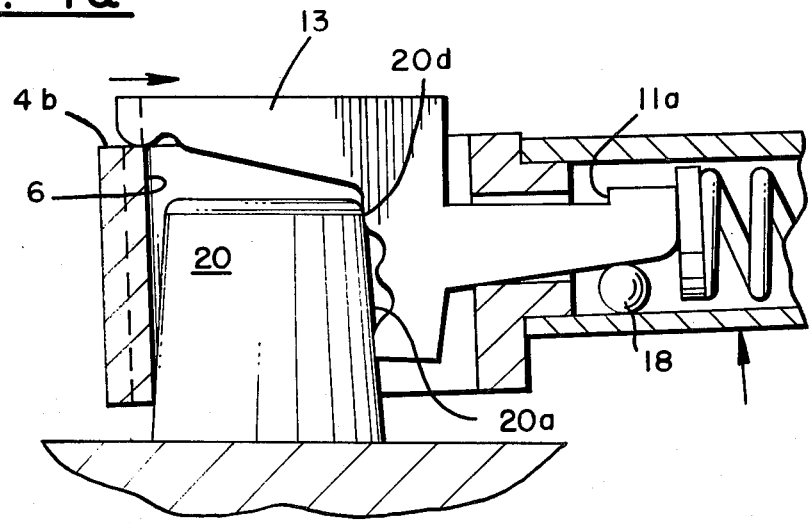
FIG. 4*a* is an enlarged partial view of the connector of FIG. 2 at the onset of upward tilting movement of the sleeve during the removal procedure.

The procedure and mechanism for removing the connector from the post 20 will now be described with reference to FIGS. **4*a*, 4*b* and 4*c*. It will be seen that this procedure is begun by the imposition of upward manual force on the sleeve 7. In FIG. 4*a* such a force, as by a hand grip on the sleeve 7, has just begun to be exerted. This force pivots the post 20 relative to collar 1 and moves probe 10 back against the force of spring 20. Continuation of this motion displaces tip 13*b* until it no longer rests on surface 4*b* of collar 1 and, the reaction force as corner of post 20 engages serrated surface 14, pivots probe 10 so that tip 13*a* is forced into collar 1 in engagement with projection 6**.

The collar itself is still in firm contact with the post 20 at side **20*c* at the lower edge. The serrated surface 14 of probe 10 begins to pull away from the side 20*a*** of the post.

FIG. **4*b* illustrates the next postion in the removal sequence. In this position, the engagement of tip 13*a* with projection 6 on the inner surface of wall 4, prevents spring 15 from displacing probe 10 toward the inner surface opposite opening 2**. This prevents gripping of a post between the probe and the collar wall.

Figure 4B:
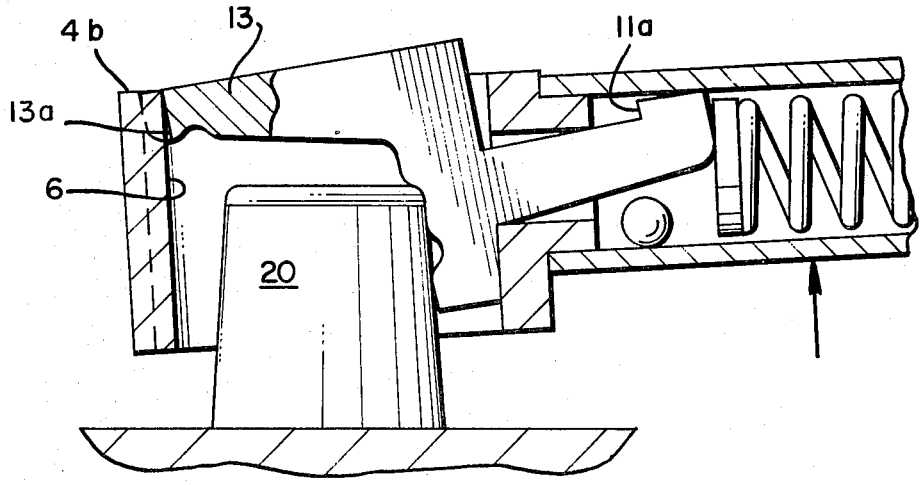
FIG. 4*b* is the same view as FIG. 4*a* at the completion of the latch probe during the removal procedure.
Figure 4C:
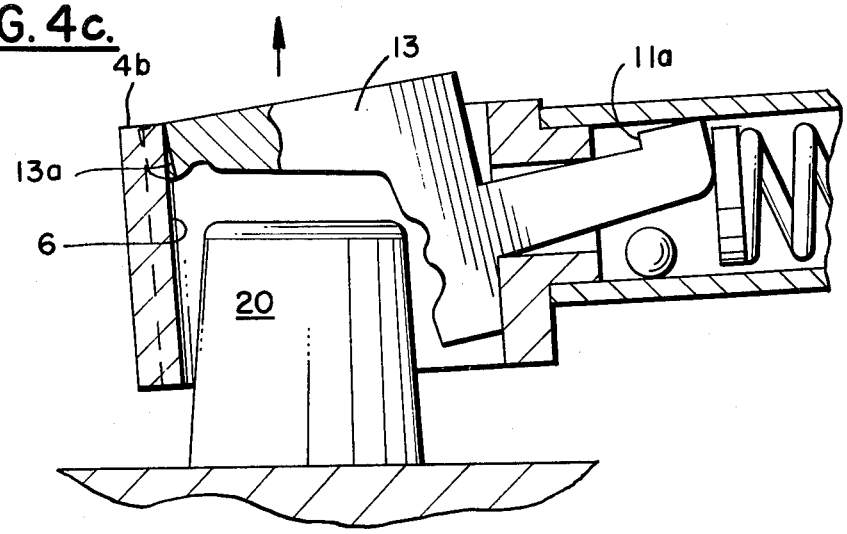
FIG. 4*c* is the same view as FIG. 4*a*, showing the connector completely disengaged from contact with a post by movement of the sleeve into the general position of FIG. 4*a*.

FIG. **4*c* illustrates the position in which the connector may be removed easily from the post: by tilting the connector slightly in the clockwise direction from the position of FIG. 4*b*, the collar is disengaged from contact with surface 20*c*, and surface 14 of probe 10 is disengaged from contact with surface 20. From this position the connector may be lifted away from the post 20**, easily.

FIG. **4*c* also illustrated conveniently, the position from which the connector of this invention may be installed on a terminal post. Thus, it can be seen that forcing the collar down around a post will displace finger 13 of a probe 10 upwardly relative to collar 1 until tip 13***a* is freed of its restraint against the inner surface of wall 4; this permits the probe to move again under the force of spring 15 to urge a post toward the inner surface, as in FIG. 2.

It should be understood that the inner surface, here shown to have axial projections or corrugations such as rib 6, may have any suitable configuration to provide firm, effective and corrosion-resistant contact with the surface of any terminal device, such as a battery post.

As before stated, the dimensions of the various components described herein are not critical in and of themselves. obviously, when the connector is designed, the dimensions of its components will depend upon the size and shape of the posts for which the connector is to be used. Functionally, when the connector is installed on the terminal post, a firm contact must be obtained between the probe 10 and collar 1, with the post therebetween. Accordingly, the post-contacting surfaces of collar 1 and probe 10 should conform with the post shape in accordance with known practices to accomplish the functions and objectives of this invention.

Representative values for the dimensions and parameters of a practical embodiment of this invention might be as follows:

Material of collar, probe and sleeve: conductive metal such as copper
Overall length of connector: 3.5"
Outer diameter of sleeve: 0.615"
Spring force on probe with terminal post engaged: 60 pounds
Inside diameter of collar: 0.72"
Typical diameter of Battery Post: 0.68"

Assembly of the component parts of the connector of this invention requires some degree of force because of the importance of spring-loading the probe into the collar. Basically, it has been found that reverse action pliers are adequate to force the probe arm 11 into the opening 2 and against the spring 15 and spacer 17. Of course, bearing 18 will already be present in the sleeve 7 when the probe arm 11 is inserted. Until used for the first time, the connector will be in the position shown in FIG. 4*b*, i.e., with probe 10 retained against spring 15 by engagement of finger 13 against the inner surface of wall 4.

While the bearing member 18 is cerainly valuable as insurance against unwanted movement of the probe 10, the connector of this invention can be constructed without it while fulfilling all the purposes intended herein. However, it is preferred that the bearing member be included in the assembly.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An electrical cable connector, comprising:

(a) a collar having a conductive metal wall for at least partially surrounding and engaging a conductive terminal member to be connected to an electrical system, said collar having an opening through the wall thereof, and having an inner portion of said wall generally opposite said opening:

(b) a sleeve extending from said collar substantially in alignment with said opening;

(c) a probe member within said collar moveable between a first position and a second position, having an arm extending through said opening into said sleeve for engagement by a resilient force-applying means, and having a contact-engaging surface positioned in substantially opposed relationship to the said inner wall portion of said collar, and further having releaseable detent means for retaining said probe in said first position wherein said contact-engaging surface is generally remote from said inner wall portion of said collar for permitting insertion and withdrawal of a conductive terminal member betweeen said wall portion and said surface; said detent means being releaseable to permit said contact-engaging surface to move toward said inner wall portion into said second position for engaging a conductive terminal member; and (d) resilient force applying means within said sleeve for urging said probe from said first position toward said second position for engaging and gripping a conductive terminal member between said contact engaging surface and said inner wall portion; and (e) means for providing a conductive path between an external conductor and said conductive metal wall of said collar.

2. The connector of claim 1, further comprising:

(a) a freely-movable bearing member within the sleeve and located between and in contact with the arm portion of said probe and an inner surface of the sleeve.

3. The connector of claim 2 wherein said resilient force-applying means comprises a compression spring and a spacer element in contact with said compression spring and the arm of said probe.

4. The connector of claim 1, wherein:

said releaseable detent means comprises a projection on said probe, and an opposed surface on said collar which abuts said projection to retain said probe in said first position against the action of said resilient force-applying means; and said projection is displaceable out of engagement with said opposed surface upon movement of said probe relative to said collar in the direction of insertion of a conductive terminal member into said collar.

5. The connector of claim 4, wherein:

said projection comprises a finger portion extending from said contact-engaging surface toward said inner wall portion of said collar and said opposed surface comprises part of said inner wall portion.

6. The connector of claim 1, wherein:

said probe may be displaced from said second position into said first position by tilting action of said connector relative to a conductive terminal member positioned between said inner wall portion of said collar and said contact-engaging surface of said probe.

7. An electrical cable connection system for connecting an electrical power source to an external conductor comprising:

(a) conductive post means operatively connected to said electrical power source, (b) a collar having a conductive metal wall for at least partially surrounding and engaging said conductive post means, said collar having an opening through the wall thereof and having an inner portion of said wall generally opposite said opening;

(c) a sleeve extending from said collar substantially in alignment with said opening;

(d) a probe member within said collar, moveable between a first position and a second position, having an arm extending through said opening into said sleeve for engagement by a resilient force-applying means and having a post means engaging surface positioned in substantially opposed relationship to the said inner wall portion of said collar, and further having releasable detent means for retaining said probe in said first position wherein said post means engaging surface is generally remote from said inner wall portion of said collar for permitting insertion and withdrawal of said conductive post means between said wall portion and said surface; said detent means being releasable to permit said post means engaging surface to move toward said inner wall portion into said second position for engaging said conductive post means;

(e) resilient force applying means within said sleeve for urging said probe from said first position toward said second position for engaging and gripping said conductive post means between said post means engaging surface and said inner wall portion wherein said collar and probe are securely joined with firm contact to said conductive post means electrically and mechanically; and (f) means for providing a conductive path between said external conductor and said conductive metal wall of said collar.

* * * * *